US006820306B2

(12) United States Patent
Huang

(10) Patent No.: US 6,820,306 B2
(45) Date of Patent: Nov. 23, 2004

(54) SIDE WHEEL ASSEMBLY OF CURTAIN TRACK

(76) Inventor: Yih-Ren Huang, P.O. Box No. 6-57, Junghe, Taipei 235 (TW)

( * ) Notice: Subject to any disclaimer, the term of this patent is extended or adjusted under 35 U.S.C. 154(b) by 0 days.

(21) Appl. No.: 10/683,225

(22) Filed: Oct. 14, 2003

(65) Prior Publication Data

US 2004/0117945 A1 Jun. 24, 2004

(30) Foreign Application Priority Data

Dec. 23, 2002 (TW) ..... 91220850 U

(51) Int. Cl.[7] ..... A47H 15/00

(52) U.S. Cl. ..... 16/102; 16/91; 16/90; 16/94 R; 248/262

(58) Field of Search ..... 16/102, 87 R, 16/87.4 R, 90, 91, 94 R, 94, 95, 96 R, 96 D; 248/262, 305, 300; 160/345; 49/409, 425; 312/334.1, 334.5

(56) References Cited

U.S. PATENT DOCUMENTS

| | | | | | |
|---|---|---|---|---|---|
| 2,913,212 | A | * | 11/1959 | Bell | 248/262 |
| 3,329,384 | A | * | 7/1967 | Salzmann | 248/265 |
| 3,337,903 | A | * | 8/1967 | Kenney | 16/87.4 R |
| 3,734,440 | A | * | 5/1973 | Hoare | 248/265 |
| 3,951,195 | A | * | 4/1976 | Salzmann | 160/345 |
| 4,957,152 | A | * | 9/1990 | Knight et al. | 160/345 |
| 5,791,394 | A | * | 8/1998 | Huang | 160/345 |
| 6,138,324 | A | * | 10/2000 | Lin | 16/87.6 R |
| 6,357,079 | B1 | * | 3/2002 | Hsu | 16/87 R |
| 6,561,475 | B1 | * | 5/2003 | Chuang | 248/264 |

* cited by examiner

*Primary Examiner*—Suzanne Dino Barrett
*Assistant Examiner*—Mark Williams

(57) ABSTRACT

A side wheel assembly of curtain track as a flexible assembly, includes a frame, a fastening member, a sealing member and related elements, which are all formed from plastic materials. The invention has a compact structure, and the elements thereof are assembled and located using simple fastening procedures, thereby accomplishing quick assembly purposes.

14 Claims, 15 Drawing Sheets

SIDE WHEEL ASSEMBLY OF CURTAIN TRACK

BACKGROUND OF THE INVENTION (a) Field of the Invention

The invention relates to a side wheel assembly of curtain track, and more particularly, to a curtain track assembled without requiring metal rivets or welding. The curtain track has plastic elements with special designs, and can be assembled by apply forces in a particular direction. The invention not only has simple assembly procedures, but also can be manufactured in mass while having high precisions.

(b) Description of the Prior Art

Referring to FIG. 9 showing a prior side wheel assembly of curtain track, the wheel assembly comprises a frame 60, and a roller assembly 70 joined by riveting means. The two parts are both formed from bending metal plates. Wherein, the frame 60 includes a main plate 61 having a relatively larger area at a center portion thereof, and a top plate 62 and a side plate 63 bent at an upper portion and an outer side portion thereof, respectively. The frame 60 is further provided with a track-protective tube 64 at an inner side thereof, wherein the track-protective tube 64 has a certain length and a breach, and is for protecting a frame-protective track 53 while also providing the frame-protective track 53 with horizontal adjustments.

The roller assembly 70 is a U-shape structure having two pivotally disposed rollers 71 and 72, and is fastened at the main plate 61 of the frame 60 using a plurality of rivets.

In addition, a sliding channel 52 in the middle of the curtain track 53 is arranged with a plurality of hooks 80. The curtain track 53 is inserted from an end portion of the track-protective tube 64 to become assembled with the track-protective tube 64. The track-protective tube 64 is additionally provided with an inwardly formed fastening compelling point 65, so as to more securely assemble the track 53 and the track-protective tube 64. However, this prior technique has the following shortcomings:

1. The frame 60 and the wheel assembly 70 according to the prior art are made of metal materials, and are formed through a lengthy process of continuous stamping, halted feeding, bending, puncturing, continued feeding, enamel coating, and assembling using rivets. Therefore, it is apparent that the aforesaid manufacturing process is rather complicated and strenuous with higher product costs as well.
2. Rivets are used in the prior art for assembly, and integrity of parts is highly liable to damages caused by the plurality of rivets used. Hence, assembly precisions are affected during processing of the prior art, and unqualified products are easily incurred.
3. The metal plates are processed using rivets to simultaneously fix the rollers 71 an 72, and precisions of the entire structure are hard to control. Therefore, rolling movements of the rollers 71 and 72 may become unsmooth or failures in assembling to the hooks may occur due to inappropriate processing during assembly.
4. The track 53 and the track-protective tube 64 are fixed merely by using a stamped fastening compelling point 65. Fastening effects are rather insufficient, with the parts being easily damaged.
5. Openings of the track 53 and the sliding groove 52 are not provided with any stopping mechanism, and thus the hooks 80 are prone to slip off from an opening of the sliding groove 52 as indicated by an arrow, and further leading to jamming or damages of the rollers 71 and 72.

SUMMARY OF THE INVENTION

The primary object of the invention is to provide a side wheel assembly of curtain track overcoming the aforesaid drawbacks of the prior art. The side wheel assembly of curtain track comprises a frame, a fastening member and other parts formed as an integral, and can be assembled using forces in particular directions, thereby providing a facilitated assembly procedure. The side wheel assembly of curtain track may be manufactured in mass while having high precisions, and thus overcomes complications of the prior art that use stamping, bending and riveting processes.

The side wheel assembly of curtain track according to the invention comprises a frame, a fastening member, a sealing member and other related elements. The frame is disposed a main plate having a top plate and a side plate at a top portion and an outer side portion thereof; and a track-protective tube having a certain length at an inner side thereof to assemble to a track with hooks. An end portion of the track is fastened by inserting into the track-protective tube at the frame.

At a bottom portion of the main plate, the frame is disposed with a bottom plate. The bottom plate and the top plate are disposed with a plurality of sets of wedge-shaped embedding members having certain distance from the main plate. Between the wedge-shaped embedding members and the main plate are embedding spaces. A fastening member extended with a plurality of protruding fastening slabs at two sides thereof is provided. The fastening member has an axial pipe at an appropriate position and stopping and fastening piece at a front end thereof; and a recess at a reversed side thereof. The recess is pivotally disposed with rollers. The fastening member is placed into an interior of the frame, and is fastened by forcing the protruding slabs into the embedding spaces in a horizontal direction. A sealing member having an axial opening at one end thereof is pivotally connected at a fixing plate via an insertion twig at the other end thereof. The sealing member has an arched section at an outer edge thereof and a stopping section at two sides thereof, respectively, so as to provide the sealing member with rotating and positioning effects.

DETAILED DESCRIPTION OF THE PREFERRED EMBODIMENTS

To better understand the contents of the invention, detailed descriptions of preferred embodiments shall be given with the accompanying drawings below.

Figure 1:
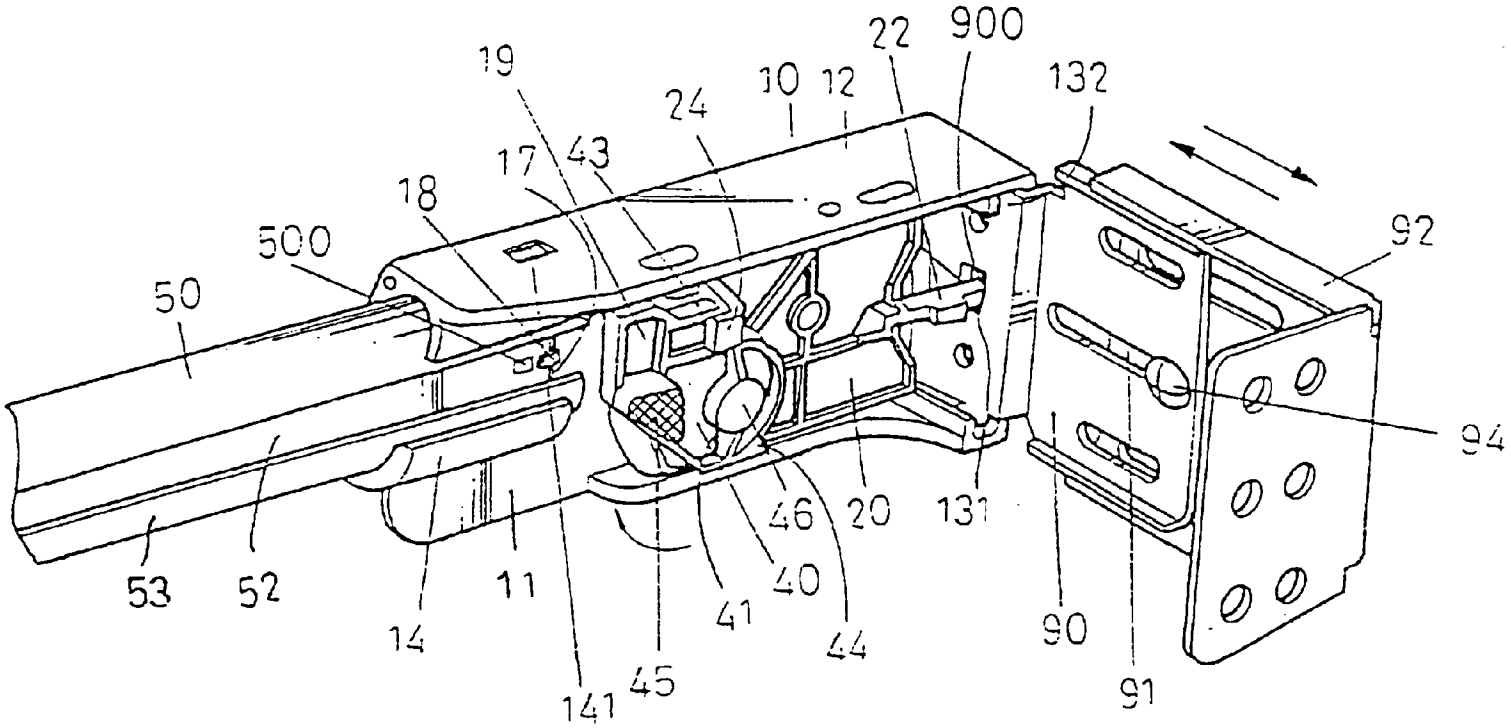
FIG. 1 shows an elevational view according to the invention.
Figure 2:
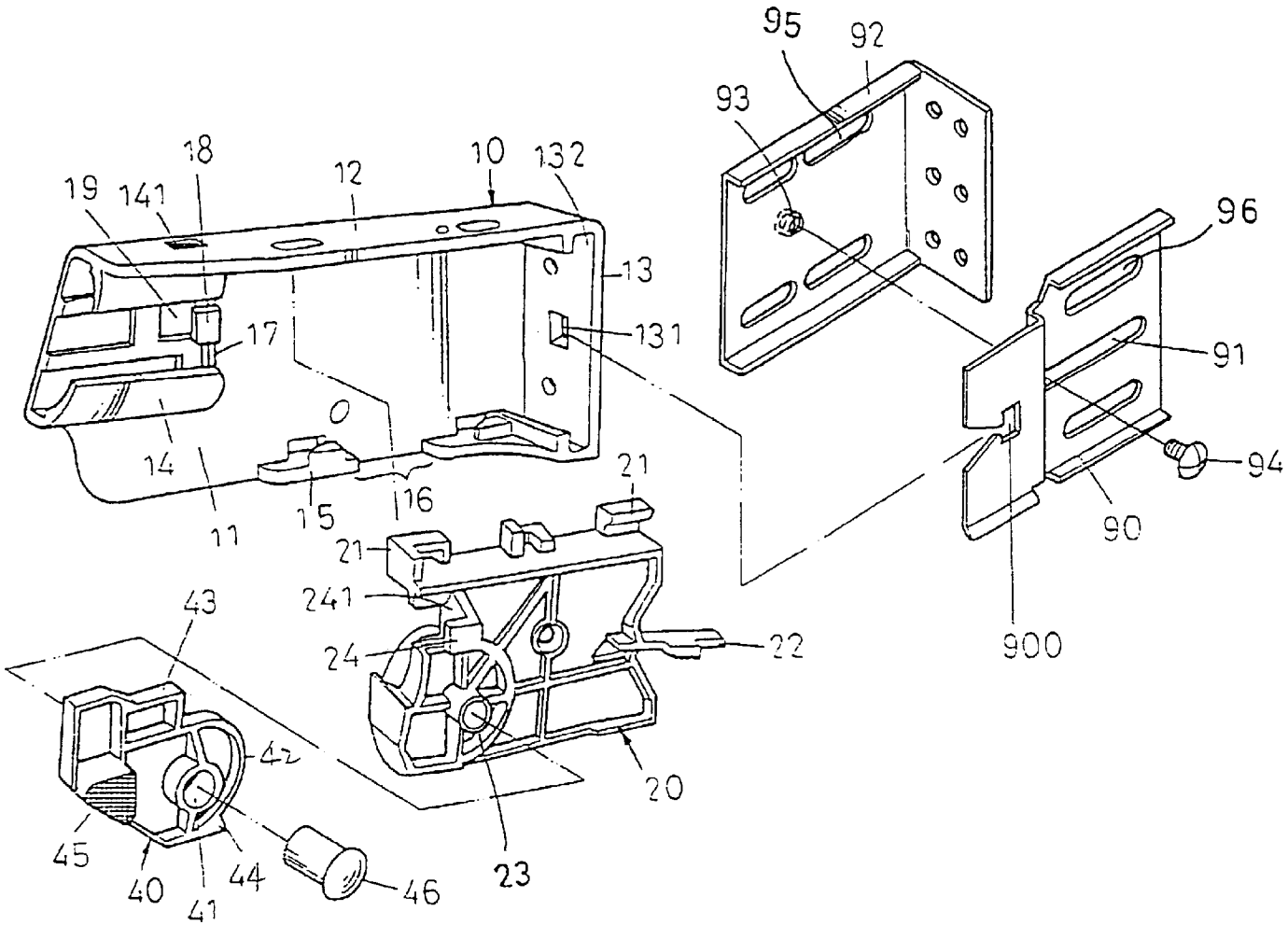
FIG. 2 shows an exploded elevational view according to the invention.
Figure 3:
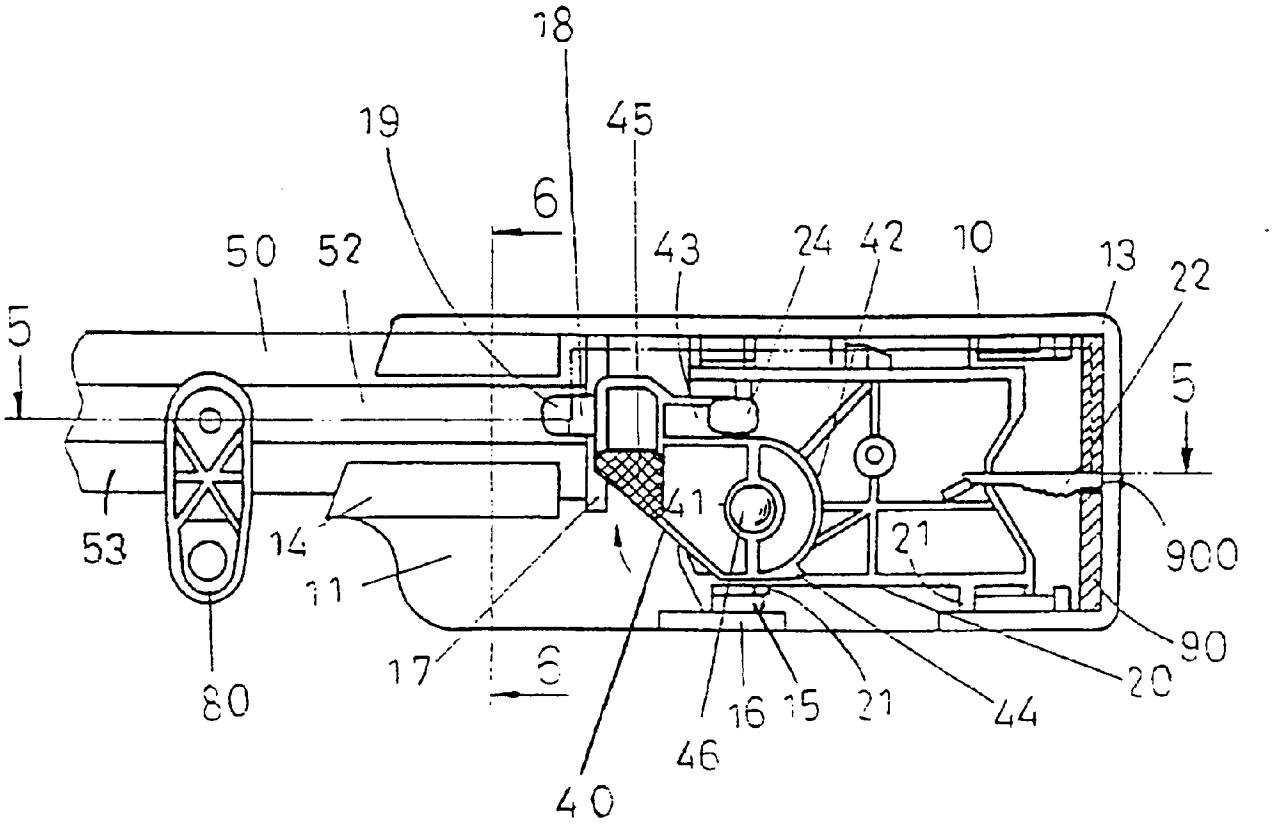
FIG. 3 shows an elevational planar structural view according to the invention.

Referring to FIGS. 1, 2 and 3, the invention comprises a frame 10, a fastening member 20, a sealing member 40 and related elements.

The frame 10 has a main plate 11 with at a larger area at center portion thereof; a top plate 12 and a side plate 13 at an upper portion and an outer side thereof, respectively; a track-protective tube 14 having a certain length formed at an inner side thereof, wherein a sectional area of the track-protective tube 14 is varied according to a sectional area of a track 50 and is joined with the track 50. In this embodiment, a sectional area of the track is C-shaped. However, other M-shaped, J-shaped, F-shaped and other irregular shaped structures applied in the industry may also be used.

Figure 5:
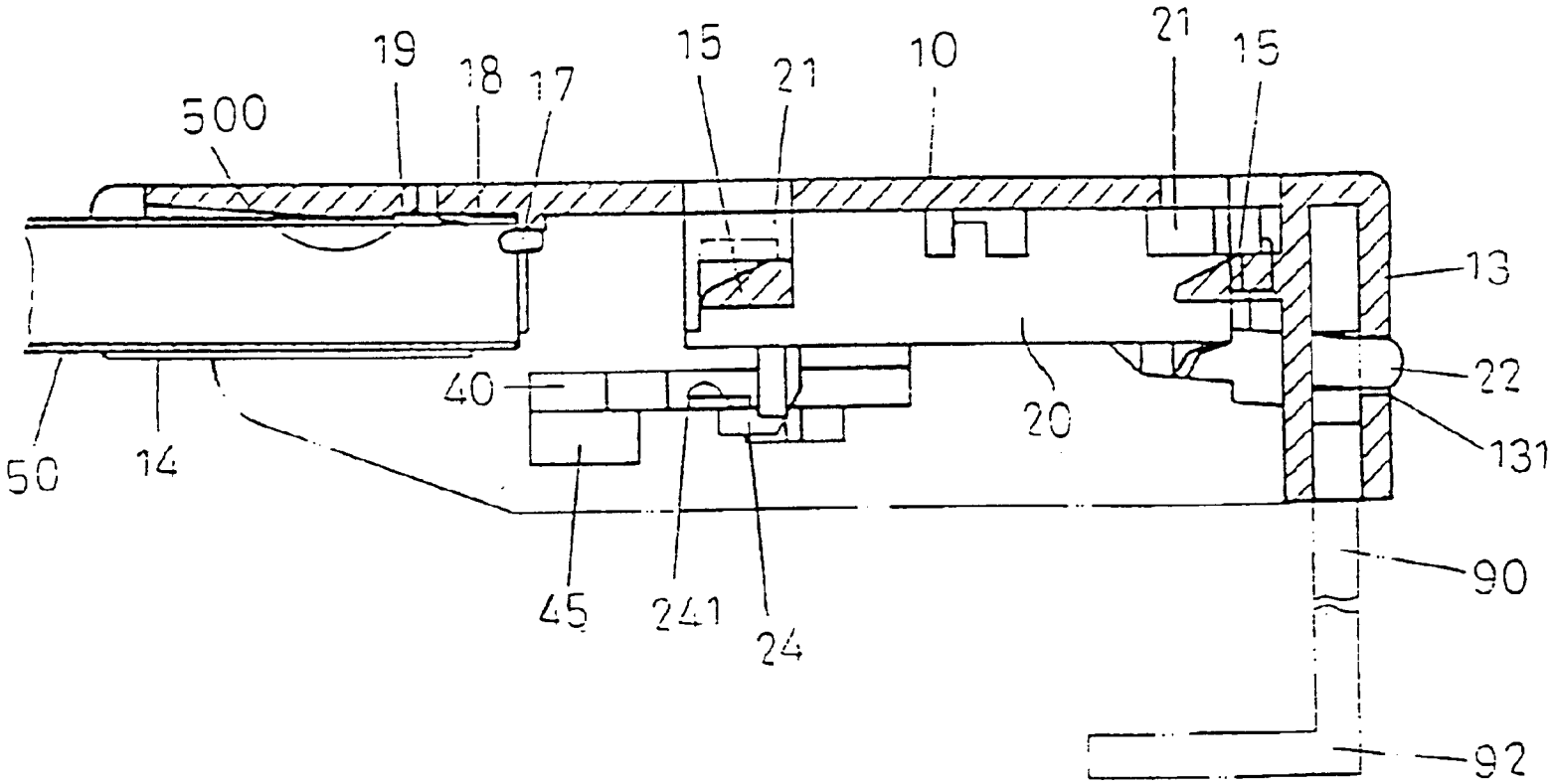
FIG. 5 shows a sectional view according to the invention taken along 5—5.
Figure 6:
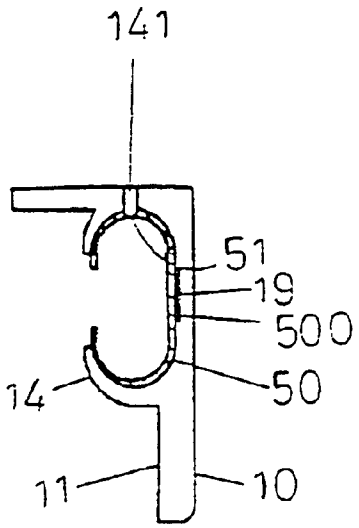
FIG. 6 shows a sectional view according to the invention taken along 6—6.

Referring to FIGS. 2, 3 and 6, the side plate 13 has a twig opening 131. The track-protective track 14 has a tongue-like elastic fastening leaf 141 at a top portion thereof. The main plate 11 has a stopping rib 17 disposed with a protruding button 18 at an appropriate position at an inner side thereof. Referring to FIGS. 2 and 5, within an area of the track-protective tube 14, the main plate 11 further has an embedding slot 19. Referring to FIGS. 1, 5 and 6, the track 50 is stamped and provided with a fastening protrusion 500 at a position corresponding to the embedding slot 19. When the track 50 is forced into the track-protective tube 14, the fastening protrusion 500 is placed and located in the embedding slot 19. To prevent longitudinal disengagement, the track 50 has a front end thereof stopped at the stopping rib 17, while the other end thereof is butted against the protruding button 18 to prevent breaking off. Again referring to FIGS. 1, 2 and 6, when the track 50 is inserted into the track-protective 14 of the frame 10, the elastic fastening leaf 141 is fastened and located into a fastening aperture 51 of the track 50 as shown in FIGS. 2 and 6, thereby reinforcing fastening strength of the track 50.

Referring to FIGS. 2, 3 and 6, the main plate 11 is provided with a bottom plate 16 at a lower portion thereof. The bottom plate 16 and the top plate 12 are provided with a plurality of pairs of wedge-shaped embedding members 15 having certain distances from the main plate 11. Between the wedge-shaped embedding members 15 and the main plate 11 are wedging spaces.

Figure 7:
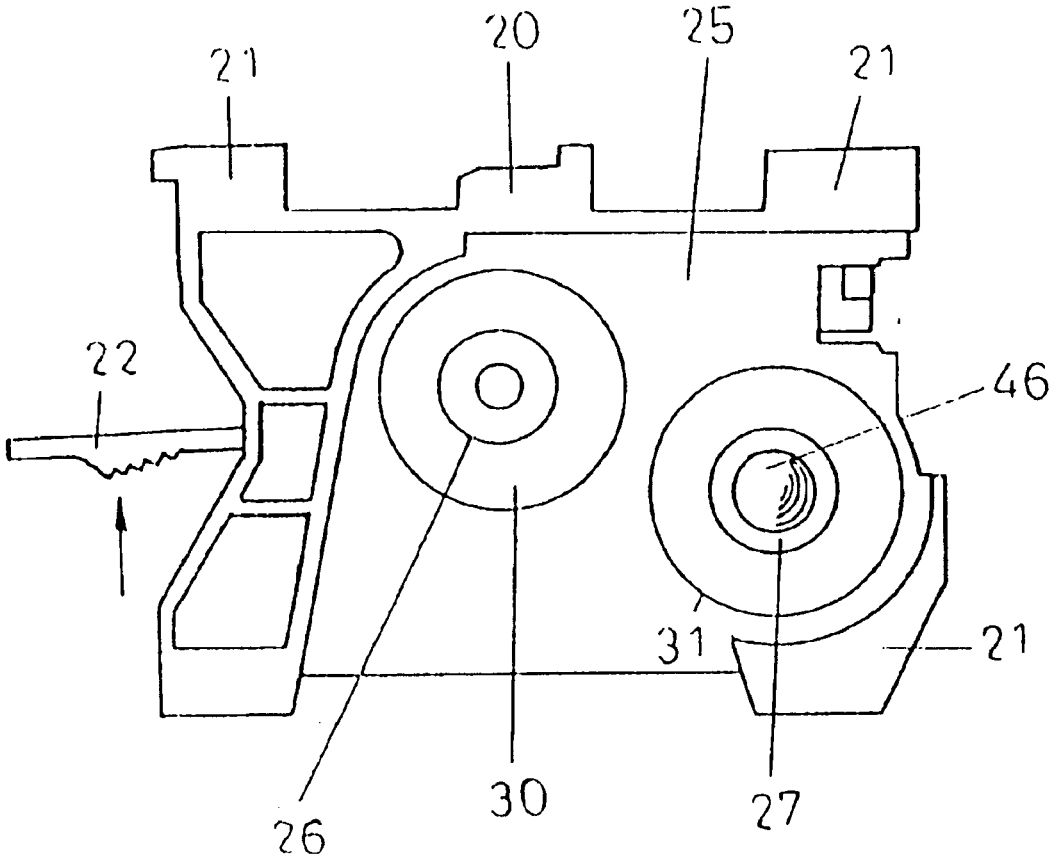
FIG. 7 shows a structural view illustrating a reversed side of a fastening member of a roller according to the invention.
Figure 8:
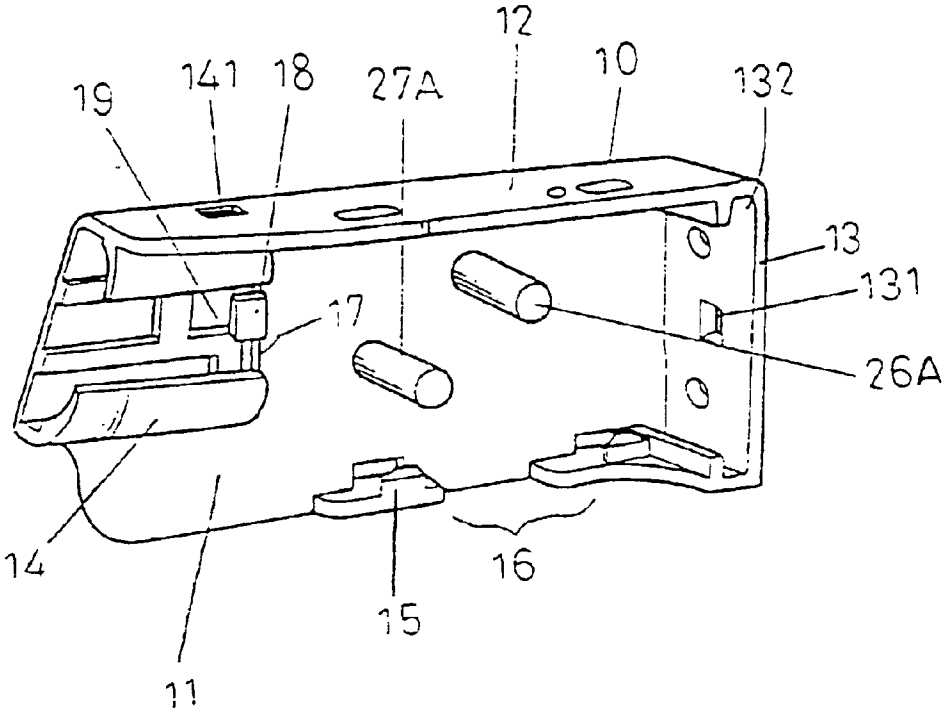
FIG. 8 shows a frame in another embodiment according to the invention.
Figure 9:
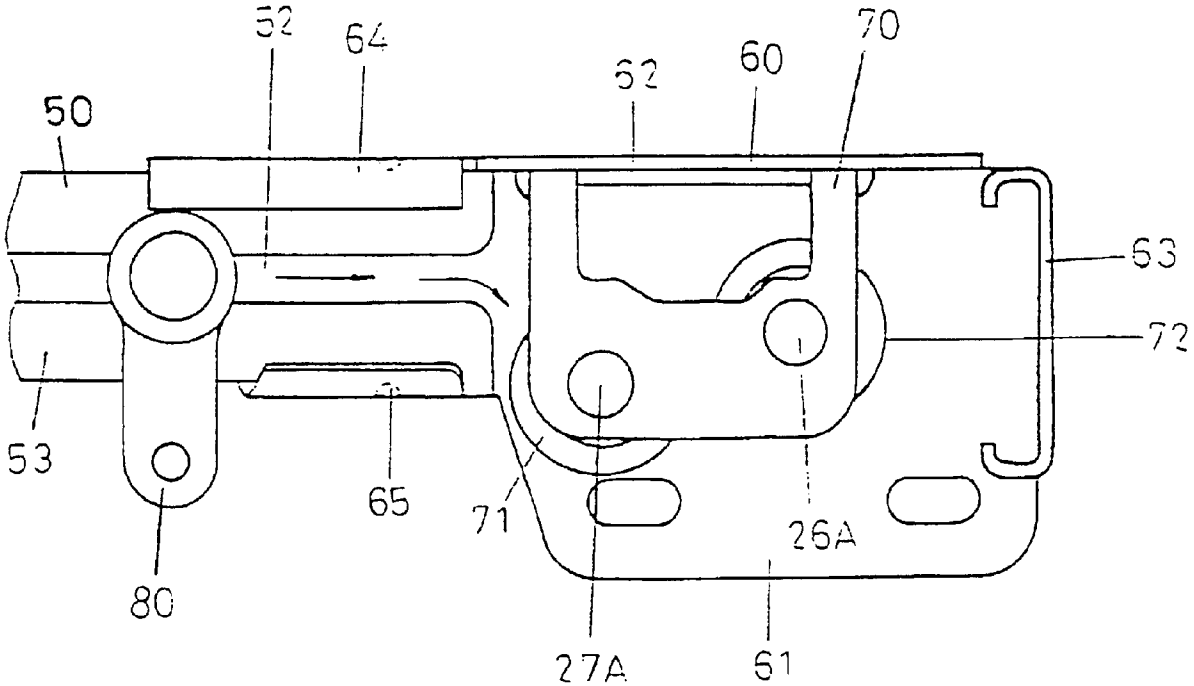
FIG.9 Prior Art
FIG. 9 shows a planar structural view of a prior art.

Referring to FIGS. 2, 3 and 7, the long fastening member 20 has a thin protruding slab 21 from two sides thereof, respectively; a projecting locating post 22 at a rear end thereof; an axial pipe 23 at an appropriate position of a front end thereof; and a 7-shaped stopping and fastening piece 24 above the axial pipe 23. As shown in FIGS. 2 and 5, the stopping and fastening piece 24 is provided with a hook section in a projecting manner at an inner end thereof to facilitate embedding and locating purposes. Referring to FIG. 8, the fastening member 20 further has a recess 25 at a center portion of the other side thereof. The recess 25 is disposed with two wheel axes 26 and 27 pivotally disposed with rollers 30 and 31, respectively.

Referring to FIG. 2, according to the invention, the sealing member 40 has an axial opening 41 at one end thereof, with the axial opening 41 being regarded as a center; an arched section 42 at an outer edge thereof; stopping sections 43 and 44 at two ends thereof, respectively; and a pushing member 45 in a triangular shape at the other end thereof.

Referring to FIGS. 1, 2, 3 and 7, the fastening member 20 disposed with the two rollers 30 and 31 is placed into an interior of the frame 10, and the protruding slabs 21 at two sides thereof are forced and secured into the embedding spaces between the wedge-shaped embedding members 15 and the main plate 10.

Figure 4:
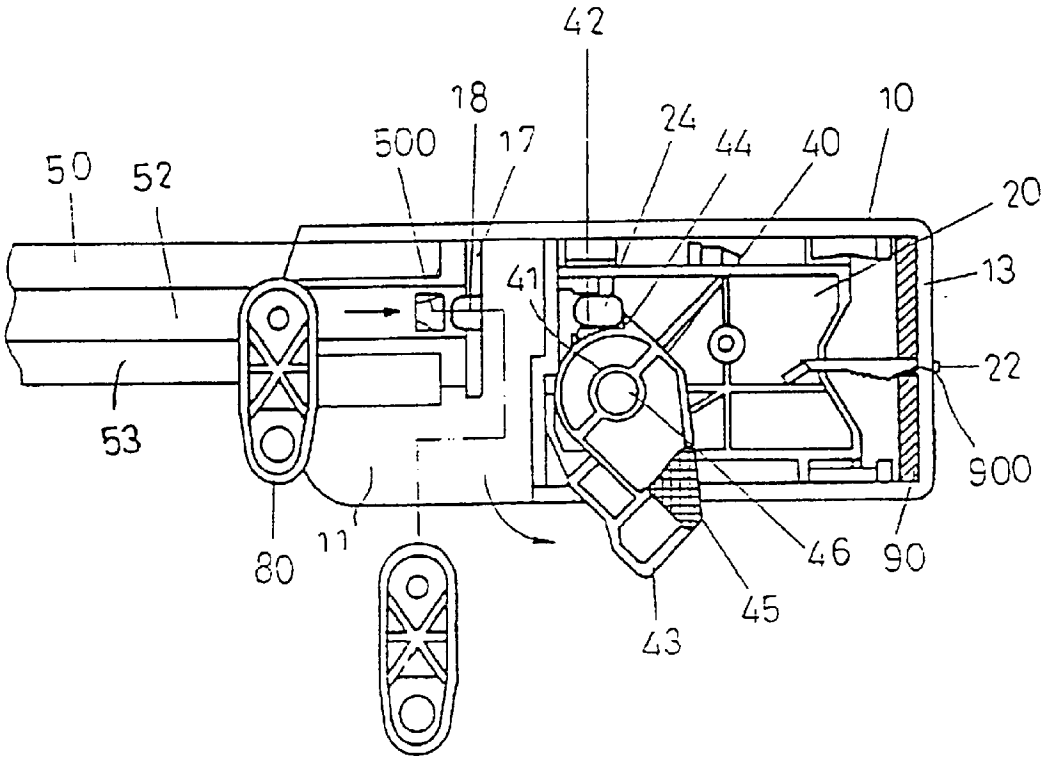
FIG. 4 shows a schematic view illustrating movements according to the invention.

Referring to FIGS. 1, 2 and 4, the sealing member 40 is accommodated around the axial pipe 23 via the axial opening 41, and is fastened using an insertion twig 46. The insertion twig 46 acts as a rotation axis, and the sealing member 40 is rotated by applying forces upon the pushing member 45. Referring to FIGS. 1 and 3, when the sealing member 40 rotates clockwise as indicated by an arrow, the stopping section 43 at one side thereof is forced and fastened below the stopping and fastening piece 24 and becomes exactly wedged at the hook section 241 to prevent the hooks 80 from falling off. Or, referring to FIG. 4, when the pushing member 45 is impelled and rotated counterclockwise to move the sealing member 40, the other stopping section 43 of the sealing member 40 is butted against the stopping and fastening piece 24 and is no longer blocked at the opening of the sliding groove. At this point, the hooks 80 may be disengaged from the sliding groove of the track 50 and be readily replaced by new parts.

Referring to FIG. 1 and 2, the side plate 13 of the main plate 10 has a twig opening 131, and insertion slots 132 at edges of inner sides thereof, so as to allow a fixing plate 90 to become wedged therein. The fixing plate 90 at least has a long opening 91, and an insertion opening 900 at one end thereof. When the fixing plate 90 is inserted into the insertion slot 132, the locating post 22 precisely penetrates through the twig opening 131, thereby fixing and locating the insertion plate 90.

According to the invention, an L-shaped auxiliary contractible plate 92 having a screw-fixing opening 93 is provided. A screw 94 is penetrated through the long opening 91 of the fixing plate 90 and then screwed into the screw-fixing opening 93. Thus, the auxiliary contractible plate 92 is allowed with sliding movements at the fixing plate 90, so as to adjust to most appropriate distances to bind curtains or to elude from protruding objects on a wall.

Furthermore, the auxiliary contractible plate 92 is provided with at least a long opening 95, and the fixing plate 90 is similarly provided with a corresponding long opening 96. When mounting the plates, the long openings 95 and 96 likely form corresponding overlapping holes for having larger areas, thereby favoring fastening screws into a wall for offering selection flexibility and assembly convenience.

Referring to FIG. 7, the two wheel axes 27 and 27 provided at the inner side of the fastening member 20 may be replaced by two wheel axes 26A and 27A disposed a t the frame 10 as shown in FIG. 8 as in another embodiment according to the invention. The structure formed also has excellent effects.

Figure 10:
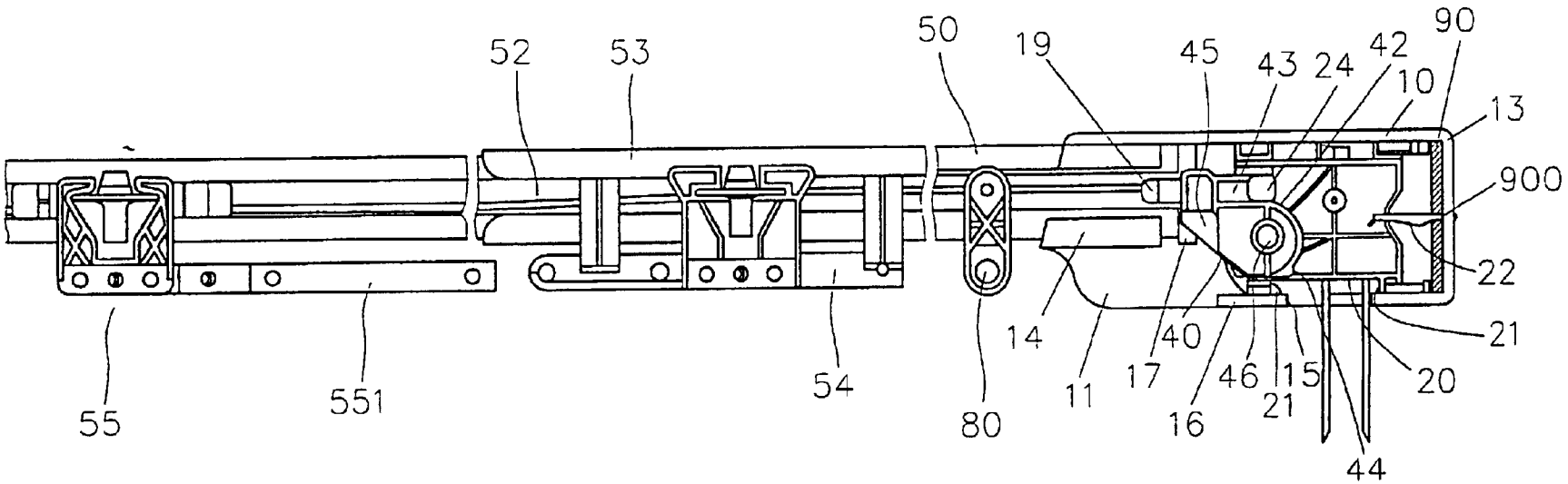
FIG. 10 shows a first elevational planar structural view illustrating a curtain being extended in conjunction with a guiding plate and an actuating arm according to the invention.
Figure 11:
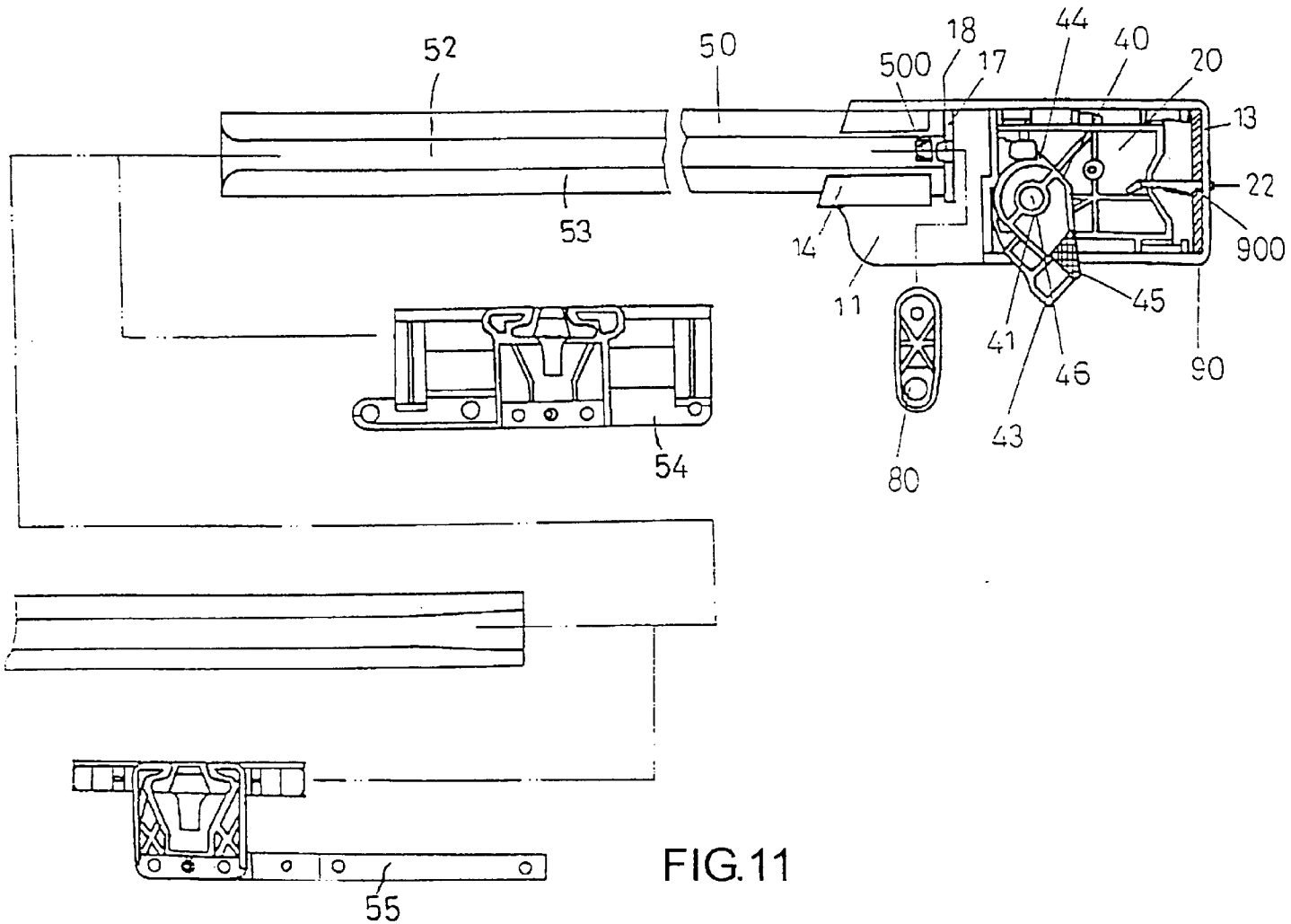
FIG. 11 shows an exploded planar view illustrating a curtain being extended in conjunction with a guiding plate and an actuating arm according to the invention.
Figure 12:
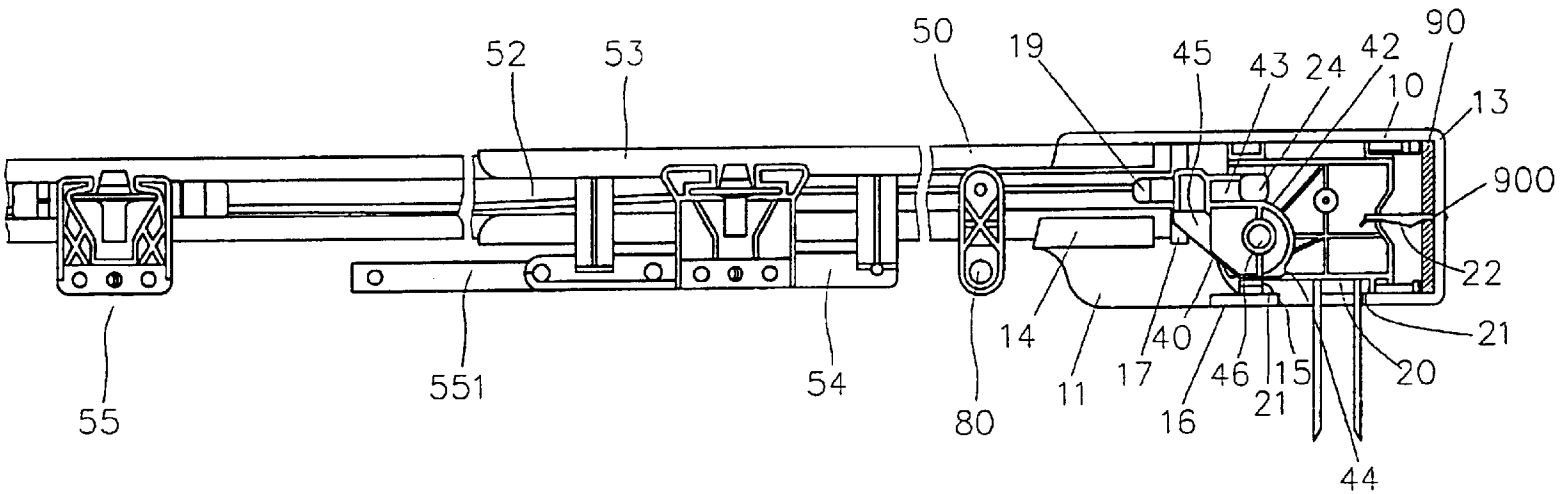
FIG. 12 shows a second elevational planar structural view illustrating a curtain being extended in conjunction with a guiding plate and an actuating arm according to the invention.
Figure 13:
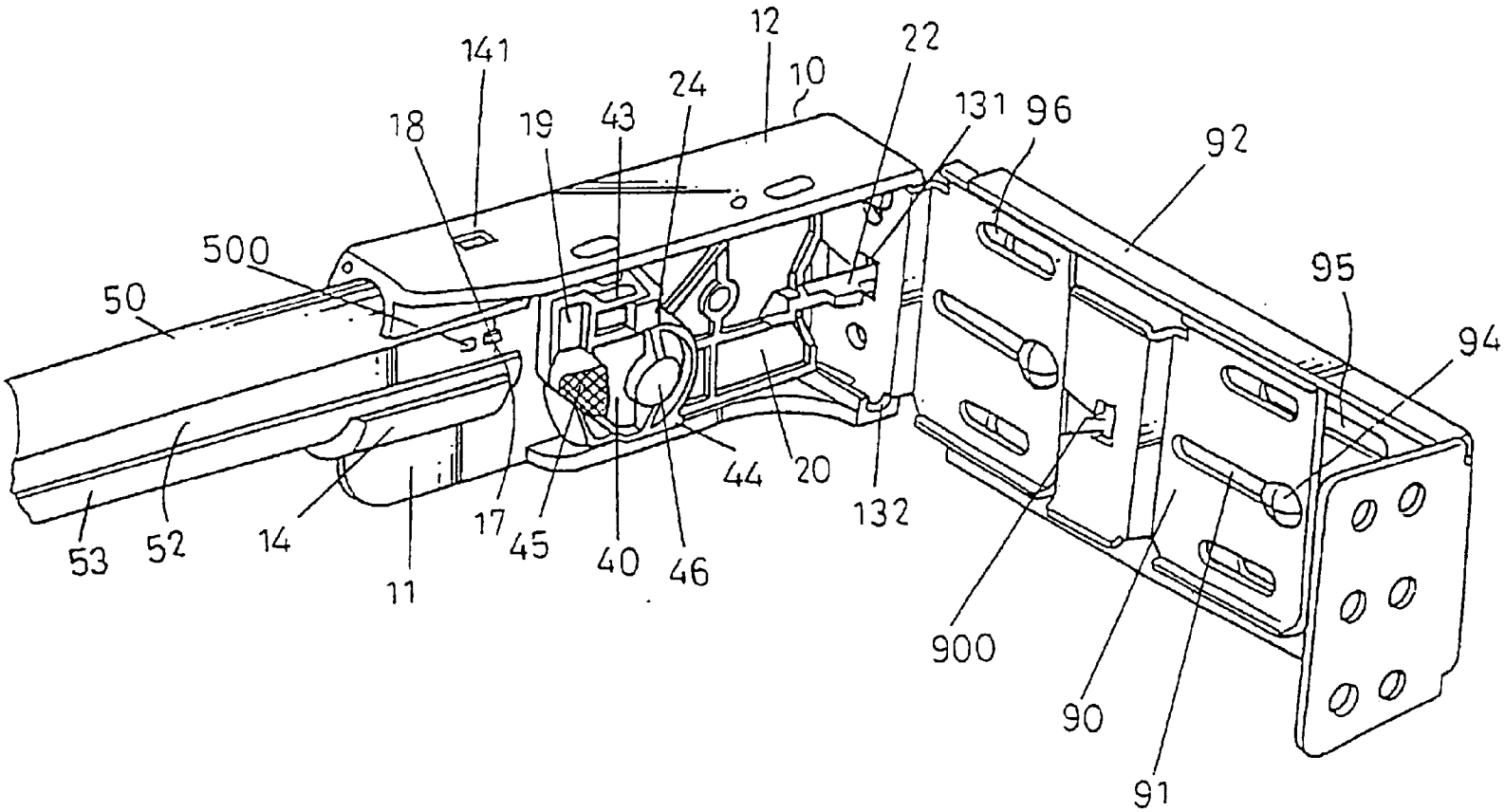
FIG. 13 shows a fixing plate in another embodiment according to the invention.

Referring to FIGS. 10, 11 and 12, according to the invention, the track groove 52 of the track 50 is provided with a guiding plate 54 for curtains, and a curtain actuating arm 55. In actual usage and installation, it is possible that the guiding plate 54 is located at a right side of the protruding plane while the curtain actuating arm 55 is located at a left side of the protruding plane. According to the invention, the sealing member 40 utilizes the stopping section 44 to butt against the stopping and fastening piece 24 for locating purposes instead of blocking at the opening of the sliding groove. Therefore, the actuating guiding plate 54 and the curtain actuating arm 55 can be taken out from end portions of the track 50, and position exchanges are made easy.

A horizontal shaft 551 below the curtain actuating arm 55 can be selectively assembled below the curtain actuating arm 55 or below the guiding plate 54 using screws. For that the horizontal shaft 551 allows the curtains to be pulled to limits thereof (usually limits that two curtains withdrawn in opposite directions), the curtains already pulled to limits thereof can be further closed using the horizontal shaft 551 that extends further than the limits of the curtains. To adapt to directions of applications, the horizontal shaft 551 may be dismantled and assembled below the actuating guiding plate 54 in order to become adjustable in all directions as wished.

Figure 14:
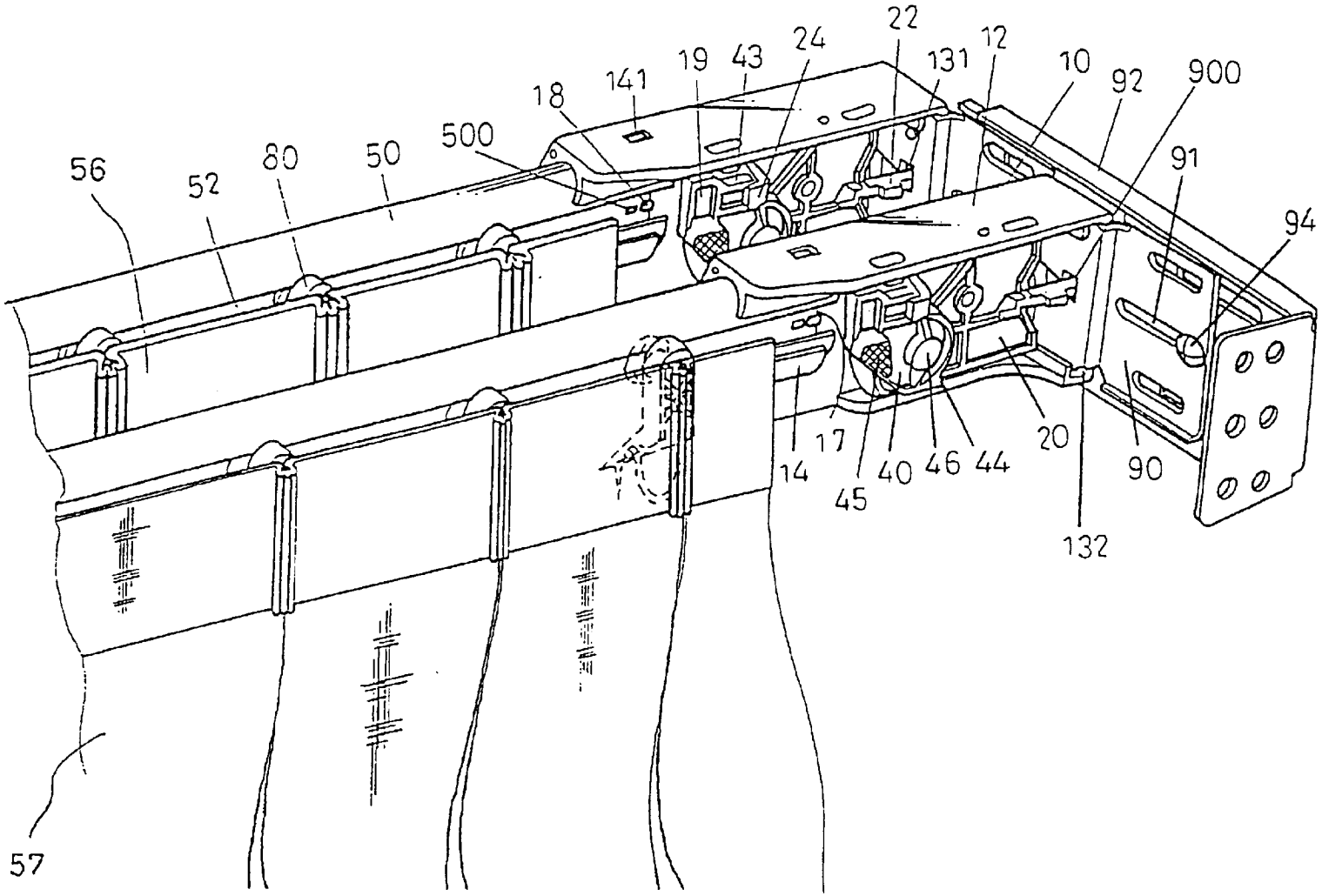
FIG. 14 shows an elevational view illustrating the invention being applied for completing a two-layer curtain structure.
Figure 15:
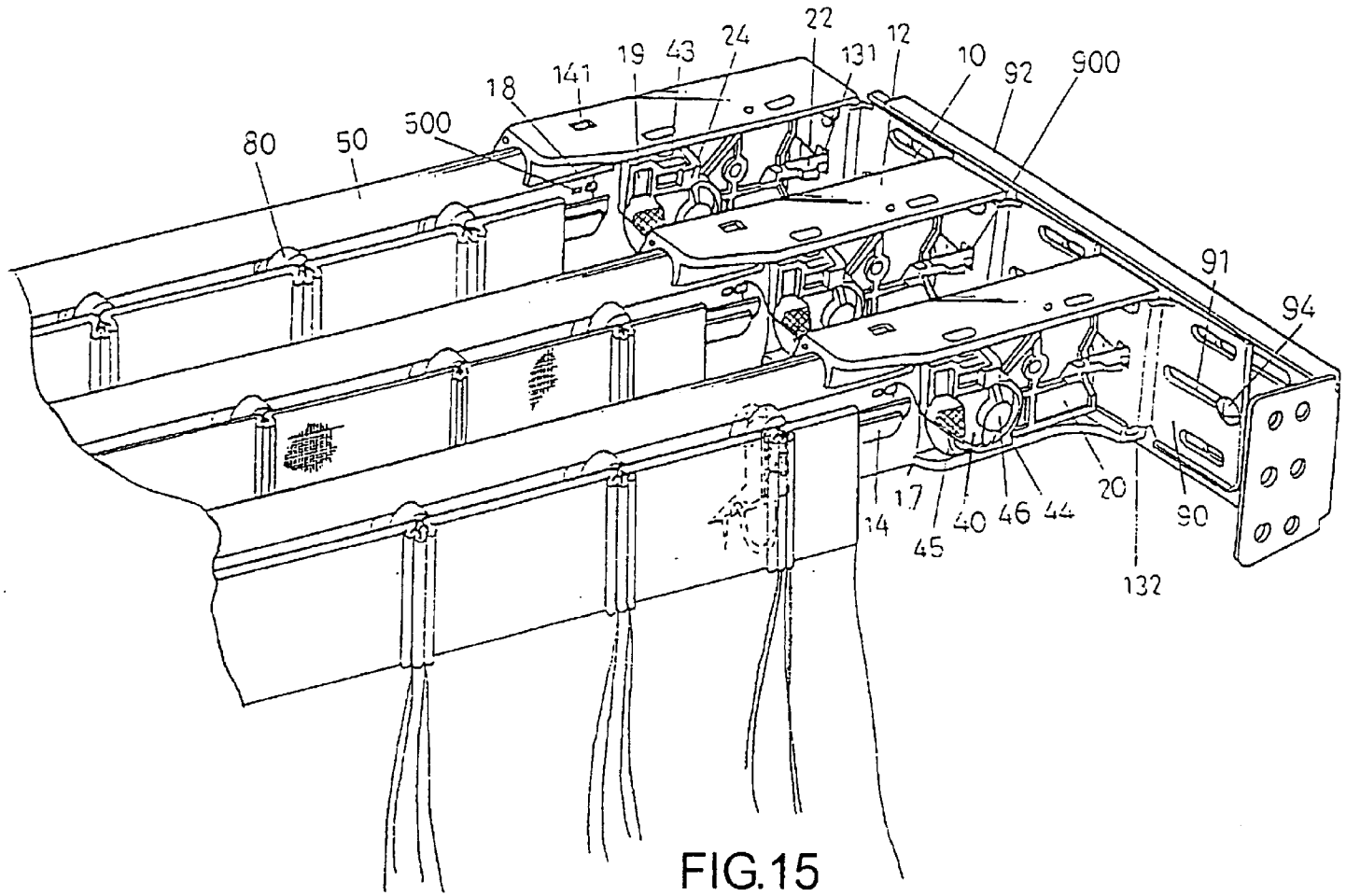
FIG. 15 shows an elevational view illustrating the invention being applied for completing a multi-layer curtain structure.

Referring to FIGS: 13 and 14, the fixing plate 90 is capable of providing a front-and-rear structure for front and rear main frames 10. Hence, another set of curtain track may be disposed in a different layer. Referring to FIG. 14, curtains hung at the front-layer and rear-layer tracks may be thicker curtains 56 for shielding sun beams and gauze curtains for producing romantic atmospheres, respectively.

Apart from the aforesaid front-and-rear structure, the frames 10 may even be provided in three-layer, four-layer, five-layer, . . . structures along with the curtain tracks, thereby hanging three, four, five, . . . sets of curtains.

The invention has the following excellences:

1. According to the invention, the frame, the roller fastening member and the sealing member may be a formed integral from plastic materials. During assembly, the sealing member is provided with an axis opening at one end thereof, so as to pivotally dispose the sealing member to the fixing plate using an insertion twig. The sealing member further has an arched section at an outer edge thereof and a stopping section at two sides thereof, respectively, such that the sealing member is provided with rotating and locating effects.
2. The invention has quick assembly processes and can be manufactured in mass. Moreover, manufacturing precisions of molds are quite high, and hence products having excellent styles and quality can be manufactured. The invention is much more time and labor efficient than the prior art processed using rivets or fastening compelling points. Also, plastic goods are less harmful to human bodies and have better safety and lighter weight without requiring enamel processing.
3. The invention employs horizontal embedding structures and provides simple procedures for both assembly and dismantling. Not only costs of manual assembly but also assembly time is reduced.
4. According to the invention, the track-protective tube is disposed with a stopping rib for positioning the track. Fastening effects are reinforced using the protruding button at the center portion and the tongue-like elastic fastening leaf at a top portion. The invention has better stability and is less likely to deformation compared to metal fastening used in the prior art.
5. The fixing plate according to the invention enables the frames to be assembled into a front-and-rear structure, and another set of curtains can be additional arranged. The two sets of curtains hung at the front and rear tracks may be provided for serving different purposed (for example, curtains having greater shielding effects, and thinner gauze curtains for creating romantic atmospheres), thereby providing a multiple of functions.
6. The L-shaped auxiliary contractible plate is provided with a screw opening. A screw is penetrated through the screw opening such that the auxiliary contractible plate is allowed with horizontal movements at the fixing plate to adjust to most appropriate positions and distances.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A side wheel assembly of curtain track comprising a frame having a main plate; a top plate and a side plate at a top portion and an outer side portion thereof, respectively; and a track-protective tube having a certain length and formed at an inner side of the main plate to assemble to a track having hooks, wherein the track is forced and fastened into the track-protective tube of the frame via an end portion thereof; and the characteristics thereof being that:

at a bottom portion of the main plate, the frame is disposed with a bottom plate; the bottom plate and the top plate are disposed with a plurality of sets of wedge-shaped embedding members having certain distance from the main plate; and between the wedge-shaped embedding members and the main plate are embedding spaces;

a fastening member extended with a plurality of protruding fastening slabs at two sides thereof is provided; the fastening member has an axial pipe at an appropriate position and stopping and fastening piece at a front end thereof, and a recess at a reversed side thereof; the recess is pivotally disposed with rollers; the fastening member is placed into an interior of the frame, and is fastened by forcing the protruding slabs into the embedding spaces in a horizontal direction;

and a sealing member having an axial opening at one end thereof is pivotally connected at a fixing plate via an insertion twig at the other end thereof; the sealing member has an arched section at an outer edge thereof, and a stopping section at two sides thereof, respectively, thereby providing the sealing member with rotating and positioning effects.

2. The side wheel assembly of curtain track in accordance with claim 1, wherein the side plate of the frame has a twig opening.

3. The side wheel assembly of curtain track in accordance with claim 1, wherein the side plate of the frame has an insertion slot at an inner side thereof.

4. The side wheel assembly of curtain track in accordance with claim 3, wherein the slot at the side plate of the frame is for inserting a fixing plate; the fixing plate is provided with at least a long opening; an L-shaped auxiliary contractible plate has a screw-fixing opening; a screw is penetrated through the long opening of the fixing plate and screwed into the screw-fixing opening of the auxiliary contractible plate, thereby enabling the auxiliary contractible plate with sliding movements at the fixing plate.

5. The side wheel assembly of curtain track in accordance with claim 4, wherein the fixing plate is capable of providing a front-and-rear structure for two sets of frame, and another set of additional curtain may be arranged.

6. The side wheel assembly of curtain track in accordance with claim 4, wherein the auxiliary contractible plate has at least a long opening at a surface thereof; the fixing plate is similarly disposed with a corresponding long opening; and when mounting the plates, the long openings likely form corresponding overlapping holes by having larger areas, thereby favoring fastening screws into a wall for offering selection flexibility and assembly convenience.

7. The side wheel assembly of curtain track in accordance with claim 1, wherein the fastening member has a locating post at a rear end thereof.

8. The side wheel assembly of curtain track in accordance with claim 1, wherein the sealing member has a projecting and triangular pushing member at one end thereof without the axial opening.

9. The side wheel assembly of curtain track in accordance with claim 1, wherein the stopping and fastening piece at the fastening member is 7-shaped and is provided with a projecting hook section at a top inner side thereof; and the stopping sections of the sealing member are fastened below the hook section when being pushed inward.

10. The side wheel assembly of curtain track in accordance with claim 1, wherein the recess of the fastening member is provided with two rollers at an interior thereof for accommodating by and pivotally disposing the rollers.

11. The side wheel assembly of curtain track in accordance with claim 10, wherein the two wheel axes of the fastening member are disposed at the corresponding frame.

12. The side wheel assembly of curtain track in accordance with claim 1, wherein the track-protective tube has a stopping rib with a fastening portion at an inner side thereof.

13. The side wheel assembly of curtain track in accordance with claim 1, wherein the main plate is further provided with an embedding slot within a range of the track-protective tube; the track is stamped with a fastening protrusion for corresponding with a position of the embedding slot; and when the track is forced into the track-protective tube, the fastening protrusion is fastened and located in the embedding slot.

14. The side wheel assembly of curtain track in accordance with claim 1, wherein the track is provided with a fastening aperture; the main plate has a tongue-like elastic fastening leaf at a top portion thereof and at the track-protective tube; and the track is located by fastening the elastic fastening leaf into the fastening aperture when being inserted and fastened.

* * * * *